US006108891A

United States Patent [19]

Ruggles et al.

[11] Patent Number: 6,108,891

[45] Date of Patent: Aug. 29, 2000

[54] SOFT VERTICAL PACKAGING/ INSTALLATION APPARATUS

[75] Inventors: Bryan K. Ruggles, Salt Lake City; Stewart F. Matthews, West Valley City, both of Utah

[73] Assignee: Newell Operating Company, Freeport, Ill.

[21] Appl. No.: 09/034,559

[22] Filed: Mar. 3, 1998

[51] Int. Cl.[7] ..... E06B 9/30; E06B 9/36

[52] U.S. Cl. ..... 29/434; 29/525.01; 160/168.1 V

[58] Field of Search ..... 29/24.5, 434, 525.01, 29/525.02, 423; 160/168.1 V, 176.1 V, 178.1 V, 900; 52/745.15, 745.16

[56] References Cited

U.S. PATENT DOCUMENTS

| | | |
|---|---|---|
| 139,043 | 5/1873 | Church . |
| 4,525,907 | 7/1985 | Tachikawa . |
| 4,662,421 | 5/1987 | Basmadji et al. . |
| 4,724,883 | 2/1988 | Leibowitz . |
| 5,017,239 | 5/1991 | Morrison . |
| 5,472,102 | 12/1995 | Clayton . |
| 5,692,553 | 12/1997 | Jensen . |

FOREIGN PATENT DOCUMENTS

| | | |
|---|---|---|
| 32 15943 | 11/1983 | Germany . |

*Primary Examiner*—S. Thomas Hughes
*Assistant Examiner*—Eric Compton
*Attorney, Agent, or Firm*—Foley & Lardner

[57] ABSTRACT

The present invention relates generally to the packaging and installation of a soft vertical blind incorporating a plurality of elongated vertical louvers and an integral, sheer curtain face. The packaging system facilitates the process of securely shipping a soft vertical blind in a box, while preventing damage to the curtain fabric that is connected to the louvers. Injection-molded plastic installation clips are configured to nest inside each other and to clip into apertures provided adjacent to the top ends of each louver. When coupled to a threaded shipping rod, the installation clips act as a clamp to secure the louvers of the soft vertical blind. Polyethylene packaging spacers with slots configured to hold individual louvers are placed periodically along the length of the blind to further secure the louvers during shipping. Select components of the packaging system are also used as components in a hanger assembly to facilitate the installation of the soft vertical blind to a mounted headrail. Steel-stamped installation hangers are used to suspend the blind from the hanger assembly at a predetermined, spaced distance in front of the mounted headrail. Each louver is then successively released from the hanger assembly and transferred to a corresponding carrier truck on the headrail to complete the installation of the soft vertical blind.

44 Claims, 6 Drawing Sheets

SOFT VERTICAL PACKAGING/ INSTALLATION APPARATUS

FIELD OF THE INVENTION

The present invention relates generally to blind systems. More particularly, this invention pertains to the packaging and installation of a vertical louver blind incorporating elongated vertical louvers.

BACKGROUND OF THE INVENTION

The advent of vertical louver-type venetian blinds has brought about new concepts in interior design for commercial and residential installations. Vertical blinds have been particularly well received in contemporary architecture where relatively large expanses of window glass are utilized or large room partitions are desired. The vertical blind may be of substantial vertical height and, when closed, may extend along a considerable horizontal length to cover a wall or a window, or to partition a room.

Conventional vertical blinds include a plurality of vertically oriented louvers (also called slats or vanes) which are discrete segments secured at their tops to carrier trucks of a mounted headrail. The louvers are adapted for lateral movement along the headrail between an open blind position, when the louvers are drawn to one or opposite ends of the headrail, and a closed position, when the louvers are positioned in generally equally spaced relation to one another along the length of the headrail. The louvers of a conventional blind are also adapted for selective rotation about their longitudinal axis between open and closed positions to control the amount of light entering between the louvers into or out of an adjacent room.

One type of vertical blind, known as a soft vertical blind, includes a continuous, sheer curtain face that is integrally secured to the front, longitudinal edges of the louvers. This product design requires proper care and handling, particularly with respect to the packaging and installation of such products.

Packaging conventional vertical blinds for shipping typically is as simple as laying the discrete slats or louvers in an appropriately dimensioned cardboard box, one on top of the other, to form a stack or column. The remaining components of the blind system, such as, the headrail, the control elements (e.g., a wand), and the mounting hardware, are then placed in the box alongside the stack of slats. A filler material may be added to prevent the items from moving during shipping. Shipping soft vertical blinds, however, is not so straightforward. Although the slats are relatively rigid and durable, the curtain is made from a rather delicate, sheer material which readily shows damage (e.g., crease lines and stretched areas) resulting from improper handling during shipping. Stacking the slats directly on top of one another (as with conventional blinds) can cause damage to the sheer curtain. Moreover, adding filler material to press against a stack of slats to secure it against movement can cause further damage to the curtain.

Installing conventional vertical blinds is also relatively straightforward. Once the headrail is mounted, each individual slat is simply removed from the box, one at a time, and then hung on an associated carrier truck of the headrail. By contrast, with a soft vertical blind, the slats cannot be removed individually from the box and clipped onto the carrier trucks one at a time because the sheer curtain integrally secures the slats together.

In light of the foregoing, it appears desirable to provide a packaging and installation system for use with a soft vertical blind. Specifically, there is a need for a system which allows a soft vertical blind to be packaged securely within a conventional shipping box, without causing damage to the sheer curtain during shipping. There is also a need for a system for facilitating the installation of a soft vertical blind (e.g., the removal of the blind from the box and the mounting of it on the headrail).

SUMMARY OF THE INVENTION

The present invention relates to a method for packaging a blind assembly for shipping. The blind assembly includes a blind having a plurality of elongated louvers and a curtain that is integrally secured to the louvers. Furthermore, the method for packaging the blind assembly includes releasably securing each louver at a predetermined, spaced distance from each adjacent louver, placing the blind inside a shipping container, and releasably anchoring the blind to the inside of a container to prevent movement of the blind during shipping.

The present invention further relates to a system for packaging a blind assembly for shipping. The blind assembly includes a blind having a plurality of elongated louvers and a curtain that is integrally secured to the louvers. The packaging system includes at least one packaging spacer configured for releasably securing each louver at a first predetermined, spaced distance from each adjacent louver and a shipping container configured for receiving the blind assembly there within.

The present invention still further relates to a method for installing a blind assembly on a wall. The blind assembly includes a headrail and a blind. The headrail has a plurality of carrier trucks, and the blind has a plurality of elongated louvers and a curtain that is integrally secured to the louvers. Furthermore, the method for installing the blind assembly on a wall includes hanging the headrail on the wall, suspending the blind at a predetermined, spaced distance relative to the headrail from at least one installation hanger, and inserting each louver onto an associated carrier truck.

The present invention even further relates to an apparatus for installing a blind on a mounted headrail that has a plurality of carrier trucks. The blind has a plurality of elongated louvers and a curtain that is integrally secured to the louvers. Furthermore, the apparatus includes at least one installation hanger configured for releasable attachment to the mounted headrail. Moreover, the apparatus also includes a hanger assembly configured for releasably coupling with the installation hanger and for releasably securing the blind adjacent to the headrail so that an upper end of each louver is suspended in a spaced relation with the carrier trucks.

According to one exemplary aspect of the present invention, the packaging system facilitates the process of securely shipping a soft vertical blind assembly in a box. In particular, the injection-molded plastic installation clips nest inside each other and clip each louver of the blind. When coupled to a threaded shipping rod, the installation clips act as a clamp to secure the louvers of the soft vertical blind during shipping. Additionally, polyethylene packaging spacers have slots configured to hold the individual louvers of the blind when packaged in the shipping container. These spacers are placed periodically along the length of the blind to secure the louvers during shipping. The soft vertical blind is then wrapped in a polyethylene bag and, along with the headrail, is fitted into the box. As a result, the blind assembly is securely packaged in the shipping container. This method not only protects the blind assembly during shipping, but it also prevents damage to the curtain fabric that is connected to the louvers.

In accordance with another exemplary embodiment of the present invention, the installation system facilitates the process of installing a soft vertical blind as a single unit. Since the fabric curtain integrally secures the louvers (or slats) together, the louvers in a soft vertical blind cannot be removed individually from the shipping box and clipped onto the carrier trucks of a mounted headrail one at a time. However, once the shipping rod is removed from the installation clips and replaced with an installation rod, the blind can be readily carried from the shipping box to the headrail as a single unit. Installation is then easily completed when the individual louvers are progressively inserted into corresponding carrier trucks on the headrail.

An economic benefit is derived by having components of the packaging system serve multiple functions, e.g., select components of the packaging system are advantageously used as components in the installation system. Thus, the multifunctional, cross-over capabilities of the packaging system components create a cost-effective method by which to package and to install a soft vertical blind. In particular, an overall decrease in production cost is achieved since most of the components used for securely packaging the blind assembly for shipping are also utilized in the installation process. For example, the installation clips that clamp the individual louvers of the blind assembly onto the shipping rod when the blind is packaged for shipping also serve to maintain the louvers securely collected on the installation rod during installation of the blind. Furthermore, the packaging spacers that hold the individual louvers in place at periodic intervals along the length of the blind during shipping also serve to support the weight of the blind assembly unit during installation. As a result, there is a decrease in the number of separate and distinct packaging and installation components needed to be manufactured.

BRIEF DESCRIPTION OF THE DRAWINGS

The preferred exemplary embodiment of the invention will hereinafter be described in conjunction with the appended drawings, wherein like numerals denote like elements and.

DETAILED DESCRIPTION

Figure 1:
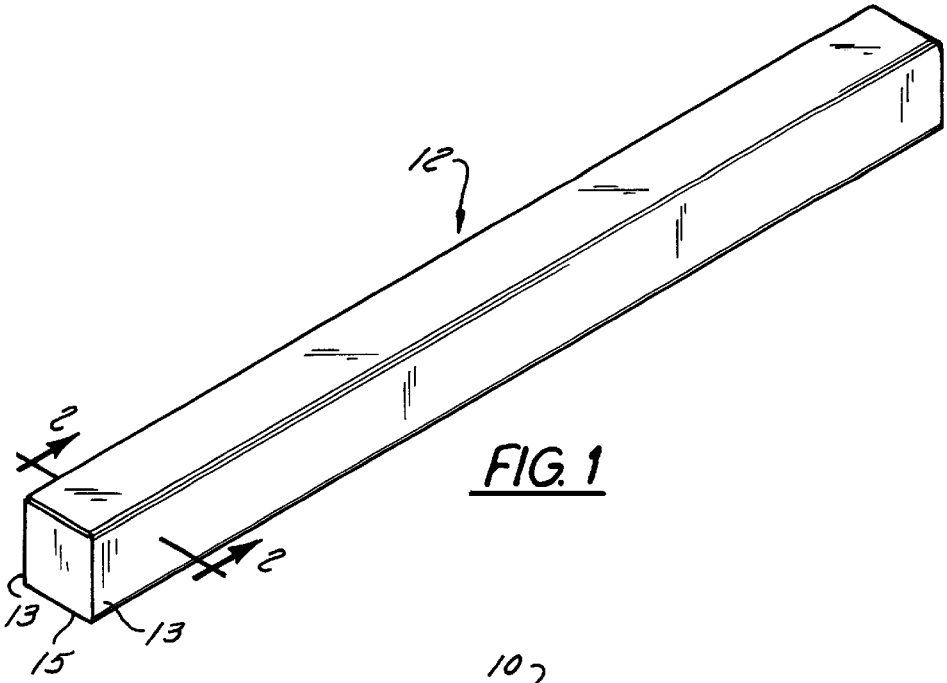
FIG. 1 is a perspective view of a cardboard shipping box with a soft vertical blind and associated components secured therein.
Figure 2:
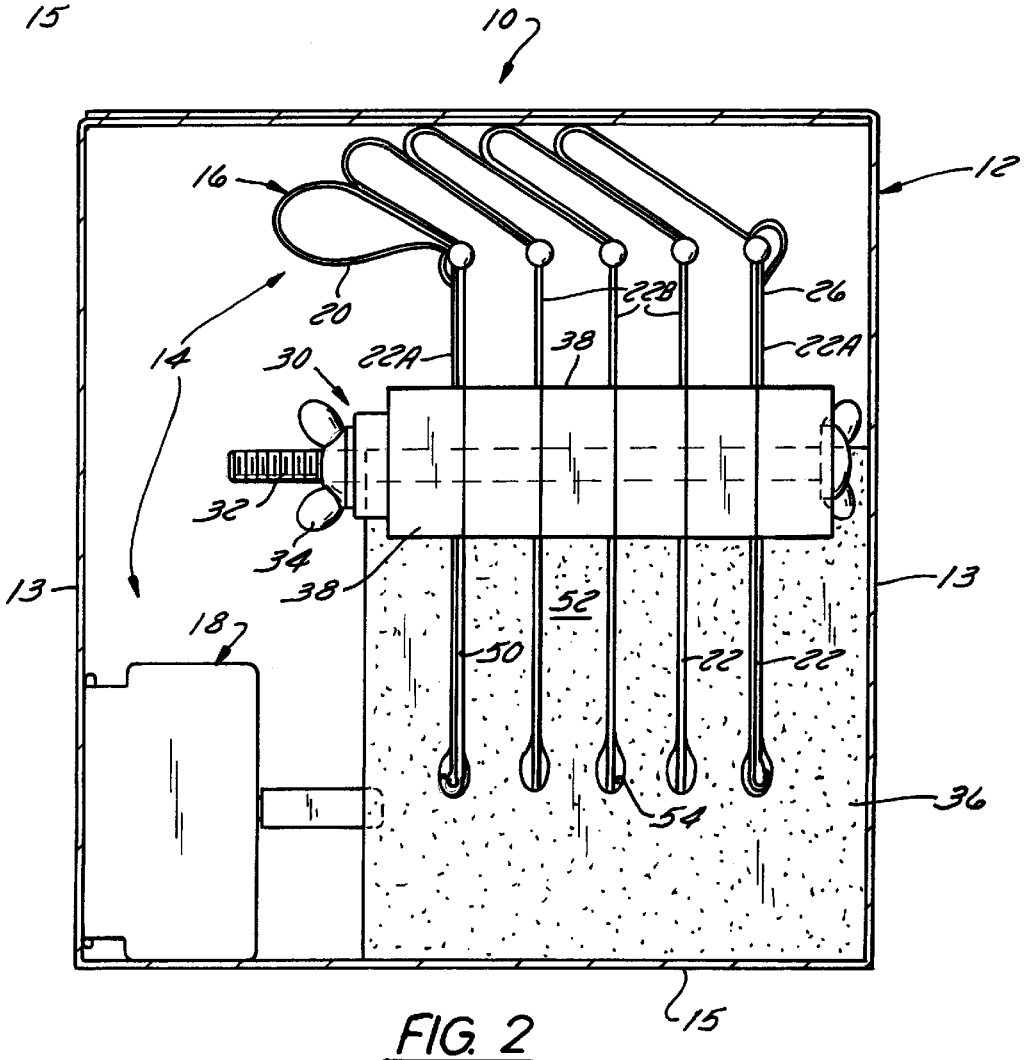
FIG. 2 is an enlarged, cross-sectional view of the shipping box of FIG. 1 taken along line 2—2 shown in FIG. 1, showing the internal components of the box secured for shipping.
Figure 4:
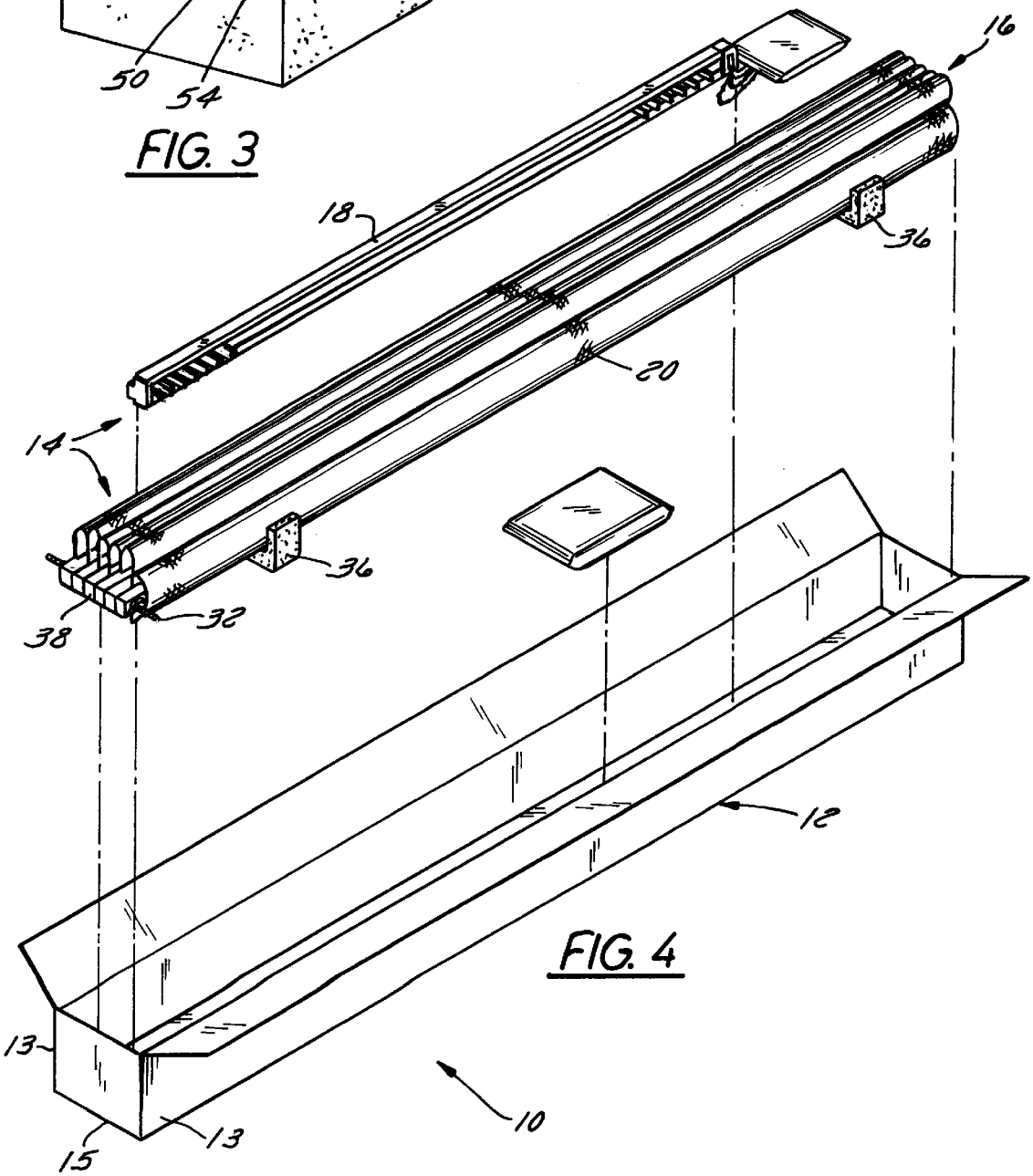
FIG. 4 is an exploded, perspective view of the shipping box of FIG. 1, showing the components enclosed within the box.
Figure 5:
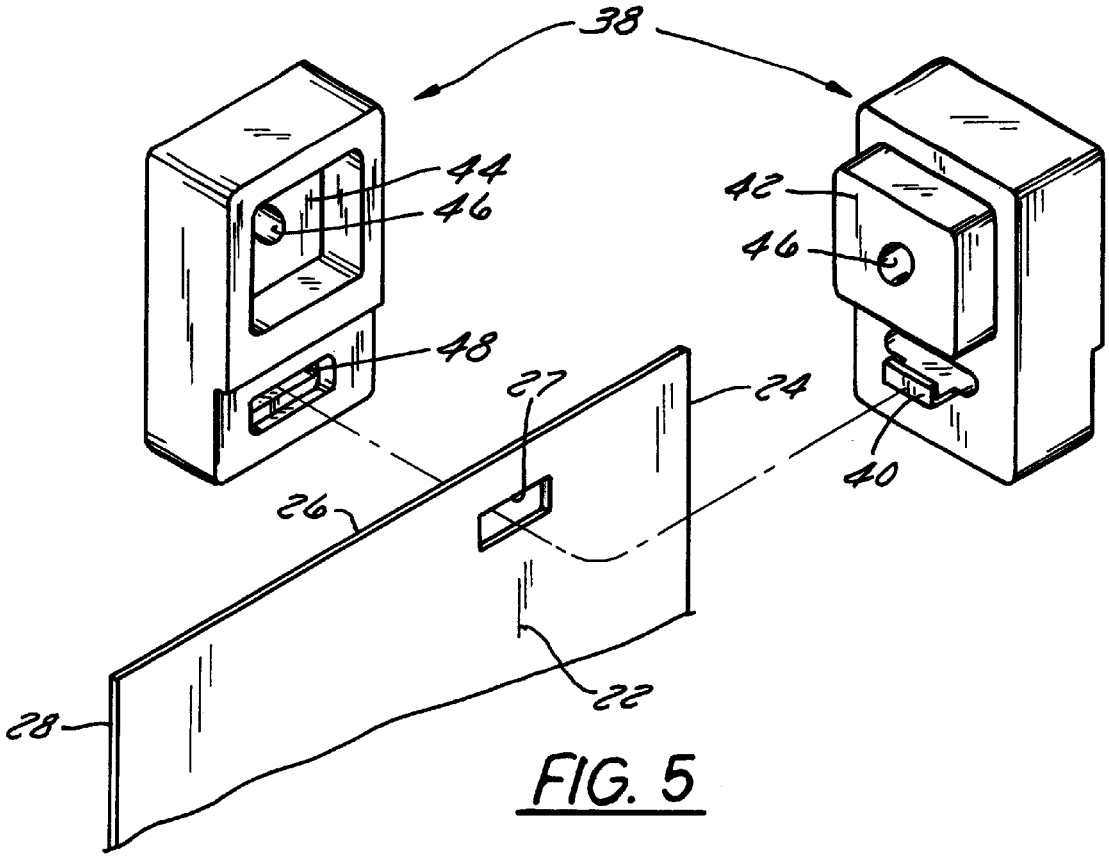
FIG. 5 is an exploded, perspective view of one louver and a pair of installation clips for securing the louver during shipping and installation of the blind.
Figure 9:
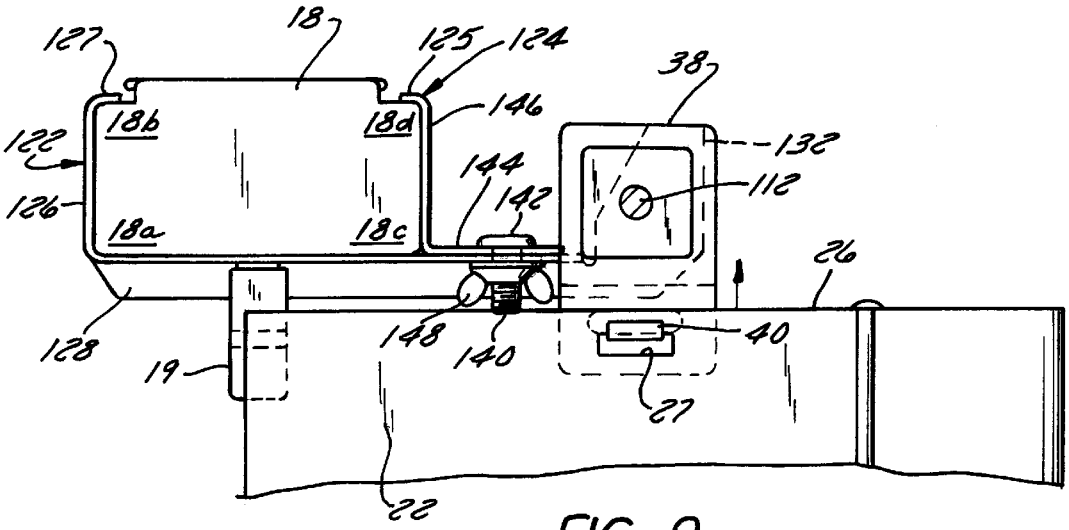
FIG. 9 is a left-side elevational view of the installation hanger secured to the headrail, showing the blind prior to transfer of the louvers to the carrier trucks.
Figure 10:
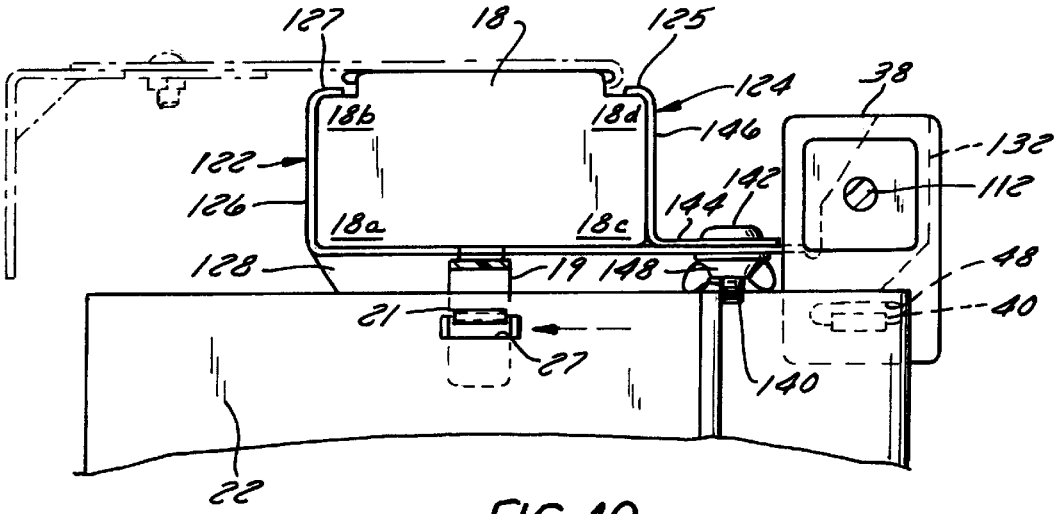
FIG. 10 is a left-side elevational view of the installation hanger secured to the headrail, showing the blind after transfer of the louvers to the carrier trucks.

With reference to FIGS. 1, 2, and 4, a packaging system 10 that includes a shipping container 12 for shipping a blind assembly 14 is shown. In particular, FIG. 2 is an enlarged, cross-sectional view of shipping container 12 from FIG. 1, demonstrating the internal components secured for shipping. Blind assembly 14 includes a blind 16 and a headrail 18. Headrail 18 further includes a plurality of carrier trucks 19. Blind 16 contains a fabric curtain 20 that is attached or integrally secured to a plurality of elongated louvers 22. Each louver 22 has a front edge 24 (FIG. 5) that is joined to curtain 20. Front edge 24 terminates at a top end 26. Additionally, an aperture 27 is provided adjacent to top end 26 of each louver 22 (FIGS. 5, 9, and 10). Each louver 22 further includes rear edge 28 and a bottom end (not shown).

In addition to shipping container 12, packaging system 10 further includes a clamping assembly 30, a threaded shipping rod 32, an at least one wing nut 34, and an at least one packaging spacer 36. Shipping container 12 includes side walls 13 and a base 15. Shipping container 12 is preferably a two-part telescoping box with fixed ends that is made of a die-cut corrugate. Alternatively, shipping container 12 can be a five-panel folding box with separate end caps to accommodate blinds of varying lengths. Additionally, shipping container 12 is preferably configured such that the dimensions comprise a length sufficient to receive the elongated louvers 22 of blind 16 and a width approximately equal to the sum of the widths of packaging spacer 36 and headrail 18. However, shipping container 12 can be comprised of other widths.

Clamping assembly 30 is preferably configured for releasably clamping top end 26 of each louver 22 of blind 16 at a predetermined, spaced distance from the top end 26 of each adjacent louver 22. However, clamping assembly 30 can also releasably clamp adjacent louvers 22 at a midsection or at a bottom end. Clamping assembly 30 includes a plurality of installation clips 38. Each installation clip 38 is preferably a unitary injection-molded plastic part. Alternatively, installation clip 38 can be a machined part made from any suitable material. As shown in FIG. 5, each installation clip 38 includes a J-shaped hook 40, a projecting portion 42, a recessed portion 44, a round aperture 46 extending through portion 44, and a cylindrically shaped or oblong aperture 48. J-shaped hook 40 in installation clip 38 is preferably configured to clip into aperture 27 provided adjacent to the top end 26 of each louver 22 of blind 16. Additionally, J-shaped hook 40 is integral with and melds into aperture 48. Projecting portion 42 of installation clip 38 is geometrically complementary to recessed portion 44 of an adjacent installation clip 38.

Figure 6:
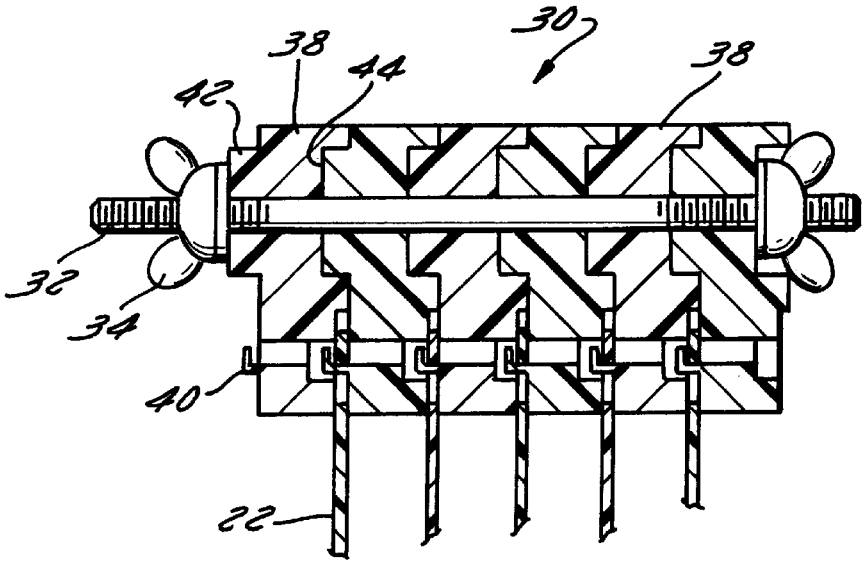
FIG. 6 is a sectional view of a plurality of installation clips shown nested together for securing the louvers during shipping.

As demonstrated with reference to FIG. 6, when one louver 22 of blind 16 is secured between a pair of adjacent installation clips 38, projecting portion 42 of one installation clip 38 is preferably configured to nest inside recessed portion 44 of the other installation clip 38. Furthermore, J-shaped hook 40 is preferably provided on the same face as projecting portion 42 of each installation clip 38, whereas aperture 48 is freely accessible on the same face as recessed portion 44. Therefore, after clipping J-shaped hook 40 of one installation clip 38 into aperture 27 provided adjacent to top end 26 of secured louver 22, J-shaped hook 40 is then inserted into aperture 48 of the complementary installation clip 38 in the pair.

Once adjacent installation clips 38 are nested within each other as individual louvers 22 of blind 16 are secured, round apertures 46 of the plurality of the installation clips 38 align. Threaded shipping rod 32 is configured to be received through aligned round apertures 46 of nested installation clips 38. In particular, round aperture 46 of each installation clip 38 is preferably configured with a circumference sufficient to receive threaded shipping rod 32. Wing nut 34, sized to fit threaded shipping rod 32, is used for applying a clamping pressure on installation clips 38 to hold louvers 22 of blind 16 securely during shipping.

As shown in FIG. 2, at least one packaging spacer 36 is used in packaging system 10 for releasably securing each louver 22 at a predetermined, spaced distance. More specifically, the distance with which packaging spacer 36 releasably secures each louver 22 is approximately equal to the distance with which clamping assembly 30 releasably clamps top end 26 of each louver 22 of blind 16. Packaging spacer 36 is preferably made of a polyethylene foam. Alternatively, packaging spacer 36 can also be made of a die-cut corrugate or of a flexible, extruded vinyl piece. Furthermore, packaging spacer 36 is preferably configured to be cube-shaped. However, a prism-shaped packaging spacer 36 can also be used.

Figure 3:
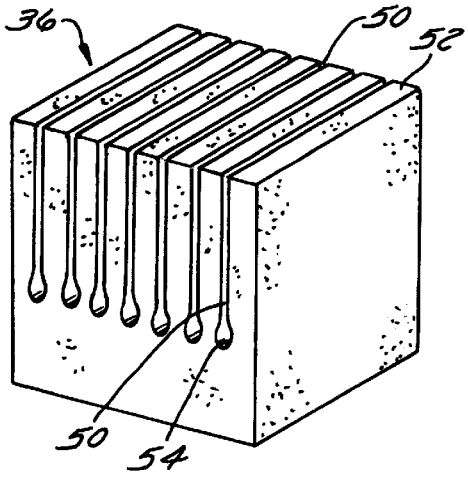
FIG. 3 is a perspective view of a packaging spacer for securing a plurality of louvers during shipping and installation of the blind.

As demonstrated in FIGS. 2 and 3, packaging spacer 36 contains a plurality of parallel slots 50 extending downwardly between equally spaced dividers 52. Each parallel slot 50 is formed within packaging spacer 36 to receive an individual louver 22 of blind 16. Additionally, each slot 50 preferably ends in a round terminus 54 that is advantageously configured to receive either one end louver 22A or one intervening louver 22B. To minimize production costs, while still giving support, packaging spacer 36 is preferably configured to have a two-inch length. Furthermore, each divider 52 in packaging spacer 36 is preferably ⅜-inch wide, whereas the thickness of each slot 50 is preferably 30/1000-inch. However, alternative dimensions can also be used for packaging spacer 36.

In one preferred embodiment, a further economic benefit is derived from the manufacturing process of the polyethylene (or styrofoam) packaging spacer 36 that results in a generically sized packaging spacer 36 that can accommodate an array of blind sizes. The styrofoam block is cut downwardly at regularly spaced intervals (e.g., the predetermined distance with which packaging spacer 36 releasably secures each louver 22 of blind 16) with a hot wire. As a result, round, bead-shaped terminus 54 is formed at the base of each cut-out or slot 50.

With reference to FIG. 4, an exploded, prospective view of shipping container 12 is shown, demonstrating components of packaging system 10 and blind assembly 14. In operation, packaging system 10 facilitates a process for securely packaging blind assembly 14 for shipping. First, each louver 22 of blind 16 is releasably secured at a predetermined, spaced distance from each adjacent louver 22. In particular, each louver 22 of blind 16 is releasably fastened to at least one packaging spacer 36. This is preferably achieved by sliding the rear edge 28 of each louver 22 into one parallel slot 50 in packaging spacer 36. As a result of all rear edges 28 of all louvers 22 of blind 16 having been inserted into corresponding parallel slots 50 in packaging spacer 36, each louver 22 then preferably aligns such that a substantially planar surface of one louver 22 faces a substantially planar surface of each adjacent louver 22. In one preferred embodiment, packaging spacers 36 are used along the length of blind 16 to secure louvers 22 at regularly spaced intervals (e.g., every 18 inches).

Secondly, top ends 26 of louvers 22 are releasably clamped to further secure blind 16 in container 12 for shipping. In particular, each top end 26 of individual louvers 22 is secured between two complementary, adjacent installation clips 38. More specifically, the J-shaped hook 40 of a first installation clip 38 in the pair is placed into aperture 27 provided adjacent to the top end 26 of the louver 22 that is being secured. After clipping into aperture 27 of the louver 22, the J-shaped hook 40 of the first clip 38 is further inserted into aperture 48 of a second complementary installation clip 38 in the pair. Furthermore, the projecting portion 42 of the first installation clip 38 in the pair nests into the recessed portion 44 of the second installation clip 38. This step is repeated until the top end 26 of every louver 22 of blind 16 is individually secured between two complementary, adjacent installation clips 38. Alternatively, the bottom end of each louver 22 in blind 16 can be individually secured.

As a result of individually securing louvers 22 of blind 16, all installation clips 38 are nested together, thereby aligning round apertures 46 of corresponding installation clips 38. Subsequently, threaded shipping rod 32 is inserted through the aligned apertures 46 of the nested installation clips 38. To apply a clamping pressure to installation clips 38, wing nut 34 is then threaded onto shipping rod 32. In one preferred embodiment, one wing nut 34 is threaded at each end of threaded shipping rod 32.

Prior to being placed inside shipping container 12, blind 16 can be wrapped in a protective overwrap, preferably a polyethylene bag. Finally, to prevent movement of blind 16 during shipping, blind 16 is releasably anchored to the inside of shipping container 12. More specifically, at least one packaging spacer 36 is wedged between opposing internal aspects of side walls 13 of shipping container 12, thereby securing rear edges 28 of louvers 22 at base 15 of shipping container 12. Additionally, headrail 18 of blind assembly 14 can be laid inside shipping container 12 so that it is wedged between packaging spacer 36 and the internal aspect of one of side walls 13 of shipping container 12. In particular, carrier trucks 19 in headrail 18 can press against packaging spacer 36, thereby securely anchoring headrail 18 against the internal aspect of one of side walls 13 of shipping container 12.

Figure 7:
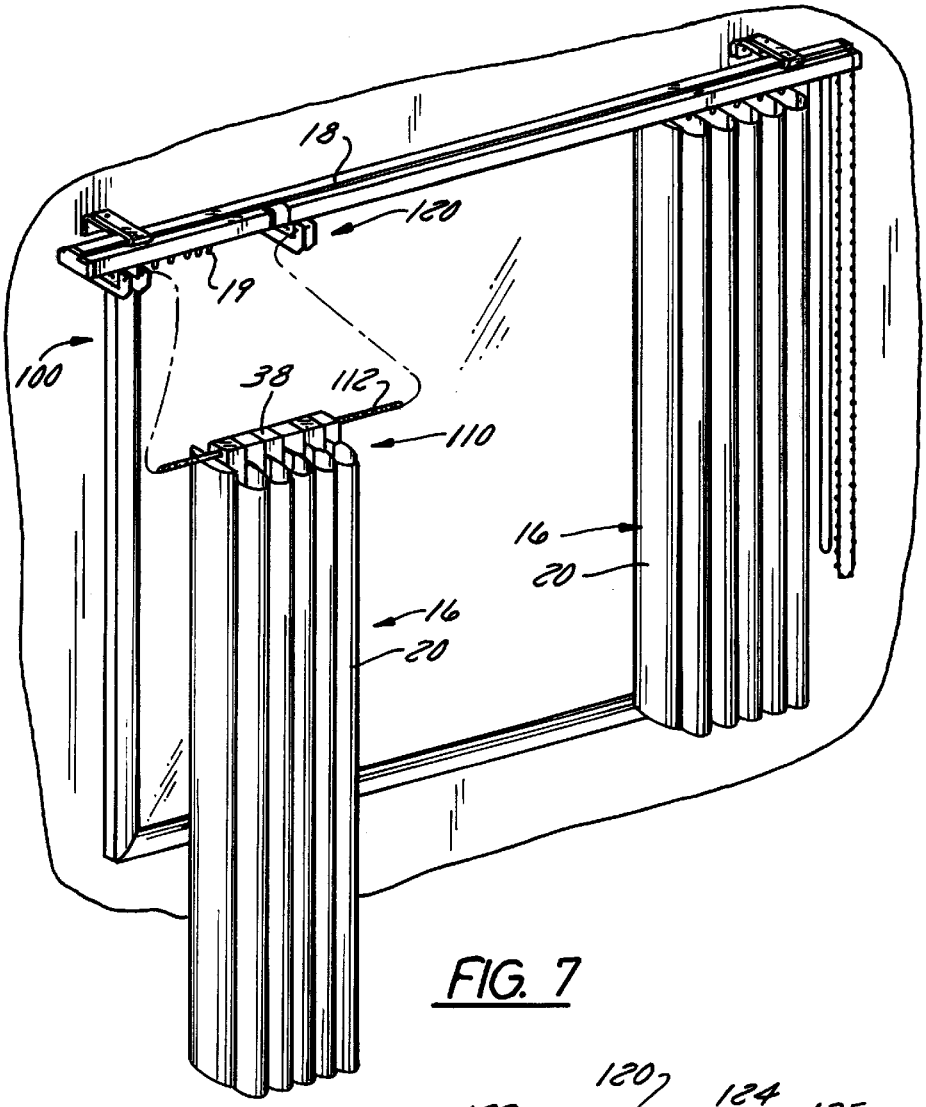
FIG. 7 is a perspective view of a soft vertical blind shown partially mounted to a headrail located above a window.

With reference to FIGS. 7, 9, 10, 11, and 12, an installation system 100 that includes a hanger assembly 110 and an at least one installation hanger 120 is shown. With reference to FIG. 7, a prospective view of soft vertical blind 16 partially mounted to headrail 18 on a wall above a window is shown. In particular, one section of soft vertical blind 16 is already installed on carrier trucks 19 of mounted headrail 18. In contrast, another section of soft vertical blind 16 is illustrated on installation system 100 in preparation for installation. Hanger assembly 110 of installation system 100 is to be suspended in front of the at least one installation hanger 120. Hanger assembly 110 preferably includes an installation rod 112 and select components of packaging system 10: the at least one wing nut 34, the at least one packaging spacer 36, and the plurality of installation clips 38 (FIGS. 2 and 3). More specifically, hanger assembly 110 is obtained when shipping rod 32 in packaging system 10 is removed from nested installation clips 38 of clamping assembly 30 and replaced with installation rod 112.

Installation rod 112 is preferably threaded. The threads prevent installation rod 112 from slipping out of installation hanger 120 and avert the potential for blind 16 to fall on the installer. Furthermore, installation rod 112 is substantially similar to shipping rod 32, except for the length: shipping rod 32 is shorter to accommodate more compact shipping. Since the circumference of installation rod 112 is substantially similar to the circumference of shipping rod 32, installation rod 112 has opposite ends that are also extendable through the aligned round apertures 46 of the nested installation clips 38.

Hanger assembly 110 is preferably configured for releasably coupling with installation hanger 120. In particular, hanger assembly 110 releasably secures blind 16 adjacent to headrail 18. More specifically, the top end 26 of each louver 22 of blind 16 is suspended by installation rod 112 of hanger assembly 110 on an outrigger 132 (FIG. 8) of at least one installation hanger 120 in a spaced relation with carrier trucks 19 of mounted headrail 18.

Figure 8:
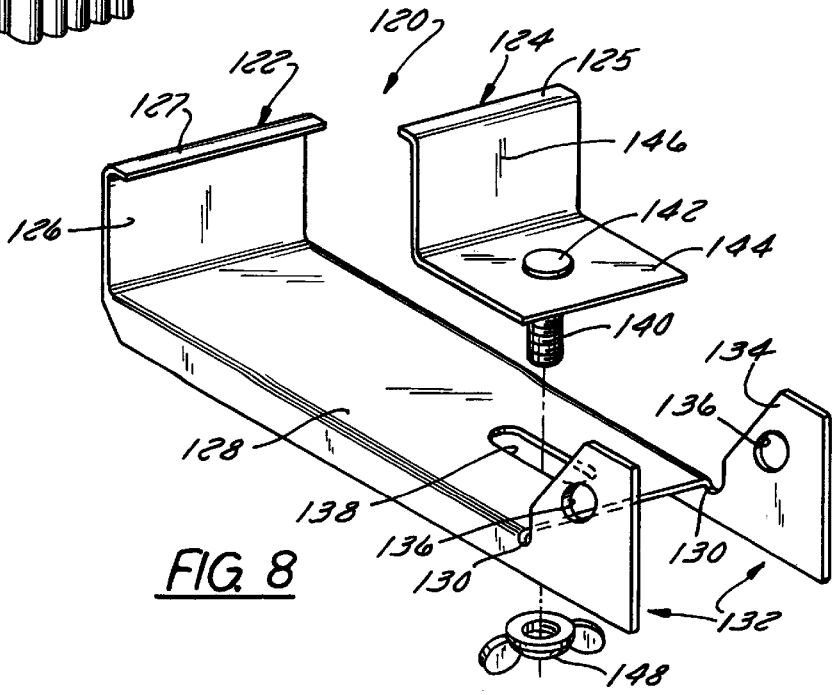
FIG. 8 is an enlarged, exploded perspective view of an installation hanger for holding the blind adjacent the carrier trucks during installation.

With reference to FIG. 8, installation hanger 120 is preferably configured for releasably attaching (e.g., clamping) to mounted headrail 18 to facilitate installation of blind 16 onto carrier trucks 19. Installation hanger 120 includes a first member 122 and a second member 124.

First member 122 includes a proximal end 126 having a top flange 127, a center portion 128, and an outrigger 132 attached to and extending from center portion 128. In particular, each lateral side of center portion 128 terminates in a curved ridge 130 that is integral with and adjacent to outrigger 132. Outrigger 132 includes a pair of frontwardly extending vertical flanges 134. Each flange 134 includes a round aperture 136 with a circumference configured to receive installation rod 112 of hanger assembly 110.

Center portion 128 of first member 122 also includes an elongated cylindrically shaped or oblong aperture 138, extending therethrough and configured to receive a bolt 140 with a head 142 that is preferably welded to a distal end 144 of second member 124. Alternatively, bolt 140 may be placed through an aperture in distal end 144.

Second member 124 includes a proximal end 146 having a top flange 125. To securely mount first member 122 and second member 124 of installation hanger 120 onto headrail 18, installation hanger 120 is attached to headrail 18 by first locating proximal end 126 of first member 122 adjacent to a rear portion 18*a* of headrail 18 such that top flange 127 is adjacent to a top portion 18*b* (FIGS. 9 and 10). Proximal end 146 of second member 124 is adequately positioned against a front portion 18*c* of headrail 18 such that top flange 125 is adjacent to a top portion 18*d* of headrail 18. The relative position of first and second members 122 and 124, respectively, is fixed by tightening a wing nut 148. Wing nut 148 is loosely threaded onto bolt 140 to provide a clamping pressure that secures the coupling of installation hanger 120 to headrail 18. Installation hanger 120 is preferably stamped from steel. Alternatively, installation hanger 120 may also be formed from other materials, such as, plastic.

FIG. 9 shows a left-side elevational view of installation hanger 120 when secured to headrail 18, while blind 16 is shown prior to the transfer of louvers 22 to carrier trucks 19 on headrail 18. In particular, proximal ends 126 and 146 of members 122 and 124, respectively, of installation hanger 120 are clamped onto headrail 18, as bolt 140 provided on distal end 144 of second member 124 passes through aperture 138 provided on center portion 128 of first member 122 and is securely threaded by wing nut 148.

Additionally, hanger assembly 110 suspends from outrigger 132 (dashed lines) of installation hanger 120. More specifically, installation rod 112 of hanger assembly 110 extends through apertures 136 of outrigger 132 and through round apertures 46 of nested installation clips 38. Moreover, J-shaped hook 40 of each of nested installation clips 38 remains clipped through aperture 27 provided adjacent to top end 26 of each louver 22, still securing each louver 22 of blind 16.

Similarly, FIG. 10 also demonstrates a side-elevational view of installation hanger 120 when secured onto headrail 18. However, in contrast to FIG. 9, blind 16 is shown after the transfer of louvers 22 to carrier trucks 19 on headrail 18. In particular, one louver 22 of blind 16 is installed onto headrail 18 as carrier truck 19 clips or traverses through aperture 27 provided adjacent to top end 26 of louver 22. While the installed louver 22 spans the distance between headrail 18 and suspended hanger assembly 110, the successive louver 22 in blind 16 is made visible, still secured by installation clips 38.

Figure 11:
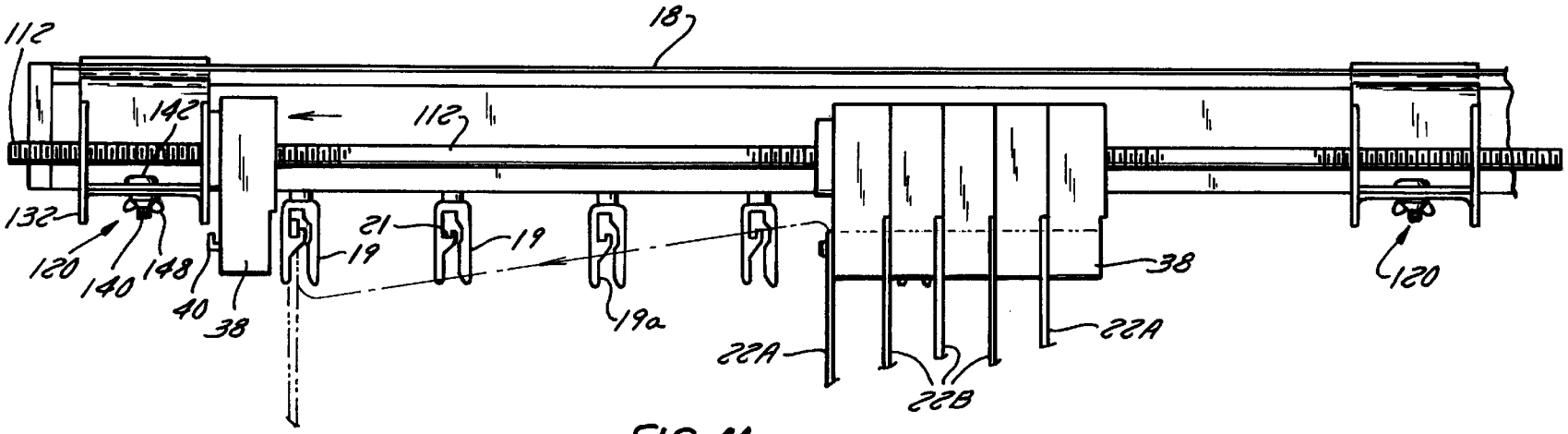
FIG. 11 is a front, elevational view of the blind and installation system, showing the blind prior to transfer of the first louver to the carrier trucks.

With reference to FIG. 11, a front elevational view of blind 16 suspended by hanger assembly 110 on installation hanger 120 is shown. Blind 16 remains secured by hanger assembly 110, which suspends from outrigger 132 of installation hanger 120. In particular, one end installation clip 38 is removed from the plurality of nested installation clips 38 of hanger assembly 110 in preparation for transferring associated end louver 22A in blind 16 onto one corresponding carrier truck 19 on headrail 18.

More specifically, as one end clip 38 is removed from the plurality of nested installation clips 38, the end louver 22A that was formerly secured by the removed clip 38 is now accessible to be installed onto one carrier truck 19 on headrail 18. More particularly, aperture 27 provided adjacent to top end 26 of end louver 22A can now be snapped or attached to a clip 21 provided on surface 19*a* (FIG. 11) of carrier truck 19. During installation, each successive louver 22 (e.g., intervening louvers 22B and end louvers 22A) of blind 16 is progressively attached or clipped into one corresponding carrier truck 19 on headrail 18. As shown with reference to FIG. 12, blind 16 is ultimately installed on mounted headrail 18 when all louvers 22 (e.g., intervening louvers 22B and end louvers 22A) have been individually transferred to one corresponding carrier truck 19 on headrail 18. In particular, louver 22 is removed from its respective clip 38, whereby clip 38 is then translated along installation rod 112 to expose the next louver. All installation clips 38 may be nested within each other and collected on one side of installation rod 112 of hanger assembly 110. Installation rod 112 still suspends from outriggers 132 of installation hangers 120.

In operation, installation hanger 120 and hanger assembly 110 facilitate a process for installing blind 16 onto carrier trucks 19 on headrail 18. As will be appreciated, the crossover functional capabilities of select components in packaging system 10 are advantageously utilized during the installation process. In particular, the at least one wing nut 34, the at least one packaging spacer 36, and the plurality of nested installation clips 38 used in packaging system 10 also serve as components in hanger assembly 110.

Before soft vertical blind 16 can be installed, headrail 18 must first be mounted on a wall. Next, blind 16 is converted from a shipping configuration (FIG. 4) to an installation configuration (FIG. 7). The conversion steps needed to obtain the installation configuration begin with removing blind 16 from shipping container 12. At this point, blind 16 is still clamped by wing nut 34 onto threaded shipping rod 32 near top ends 26 of louvers 22 in a spaced relation to each other by the plurality of installation clips 38. Moreover, individual louvers 22 of blind 16 are still further secured into slots 50 of at least one packaging spacer 36. Wing nut 34 is then removed from shipping rod 32, thereby allowing the withdrawal of threaded shipping rod 32 from round apertures 46 of the nested installation clips 38.

While slots 50 of packaging spacer 36 still secure louvers 22 of blind 16, the plurality of installation clips 38 remain nested within each other, thereby maintaining alignment of round apertures 46. Installation rod 112 is now inserted through the aligned round apertures 46 of the nested installation clips 38. In a preferred embodiment, wing nut 34 is then replaced on threaded installation rod 112 and subsequently tightened, thereby reclamping louvers 22 of blind 16 in the same spaced relation to each other as in the packaging configuration. This step obtains the hanger assembly 110 configuration and facilitates carrying blind 16 from container 12 to headrail 18 as a single unit. However, nested clips 38 may still secure louvers 22 on installation rod 112 without using wing nut 34.

Figure 12:
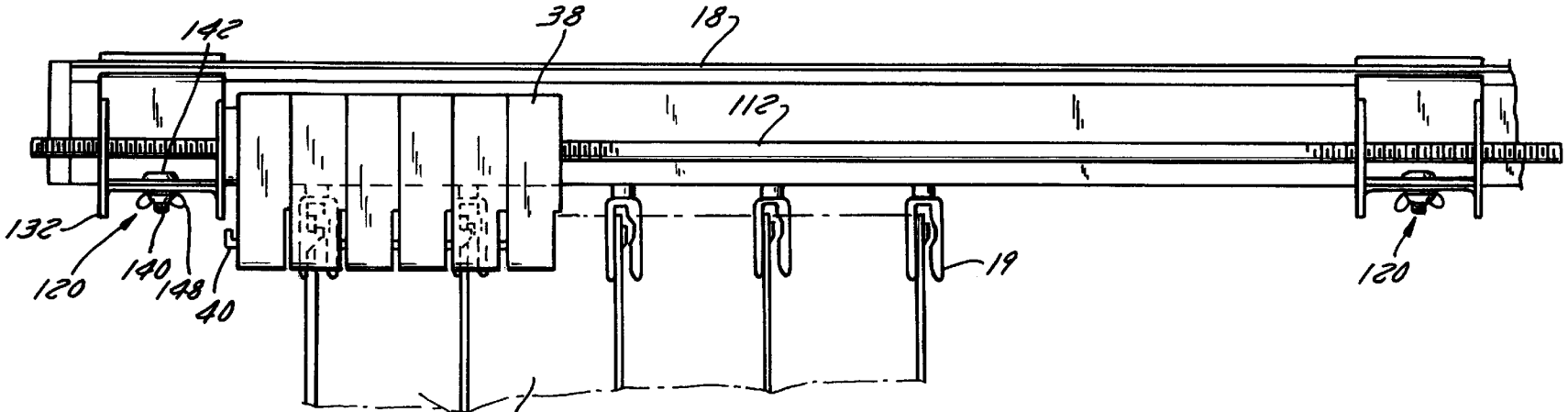
FIG. 12 is a front, elevational view of the blind and installation system, showing the blind after transfer of all the louvers to the carrier trucks.

The next phase in the installation process is to suspend hanger assembly 110 with blind 16 from installation hangers 120 at a predetermined, spaced distance from the mounted headrail 18. To accomplish this, installation hangers 120 are releasably secured to headrail 18. Before securing the installation hangers 120, the carrier trucks 19 are stacked to one side of the mounted headrail 18. Each of the installation hangers 120 is then positioned on opposite sides of the stack of carrier trucks 19 on headrail 18 (FIG. 7, 11, and 12). In particular, proximal ends 126 and 146 of members 122 and 124, respectively, of each installation hanger 120 are clamped onto headrail 18. More specifically, proximal end 126 of first member 122 is located adjacent to rear portion 18*a* of headrail 18 such that top flange 127 is adjacent to top portion 18*b* (FIGS. 9 and 10). Proximal end 146 is then appropriately positioned against front portion 18*c* of headrail 18 such that top flange 125 is adjacent to top portion 18*d* of headrail 18. Tightening wing nut 148 fixes the relative position of first member 122 to second member 124 on headrail 18.

Hanger assembly 110 with blind 16 is now readily lifted to headrail 18. In particular, nested installation clips 38 and at least one packaging spacer 36 maintain louvers 22 securely collected on installation rod 112, thereby facilitating the transport of soft vertical blind 16 as a single unit. To suspend hanger assembly 110 with blind 16 from installation hangers 120 on mounted headrail 18, each end of installation rod 112 is inserted through apertures 136 of outrigger 132 of each installation hanger 120 (FIG. 11).

Once hanger assembly 110 with blind 16 is suspended from installation hangers 120 at a predetermined, spaced distance from mounted headrail 18, packaging spacer 36 is removed from blind 16. Also, wing nut 34 is removed from installation rod 112 of hanger assembly 110 to enable the successive release of individual installation clips 38 in preparation for transferring each louver 22 of blind 16 onto a corresponding carrier truck 19 on mounted headrail 18. More specifically, as one installation clip 38 is removed from the plurality of nested installations clips 38, the associated louver 22 that was formerly secured by the removed clip 38 is now accessible for installation onto a corresponding carrier truck 19 on mounted headrail 18. More particularly, aperture 27 provided adjacent to top end 26 of each louver 22 is attached to clip 21 provided on surface 19*a* of a corresponding carrier truck 19. As this step is successively repeated to release each individual installation clip 38, each louver 22 is progressively transferred onto a corresponding carrier truck 19 on mounted headrail 18, until all louvers 22 of blind 16 are finally installed (FIG. 12). After complete installation of blind 16, installation hanger 120, along with hanger assembly 110, can be removed from mounted headrail 18 by simply reversing the clamping process.

Although a variety of embodiments have been described herein, it should be understood that the above description is of preferred exemplary embodiments of the present invention and that the invention is not limited to the specific forms described. For example, an alternative configuration to the preferred cube-shaped polyethylene packaging spacer is a prism-shaped packaging spacer made of a die-cut corrugate. In addition, instead of the two-part telescoping box with fixed ends, the shipping container can also be a five-panel folding box with separate end caps to accommodate blinds of various lengths. Such other constructions are, nevertheless, considered within the scope of this invention. Accordingly, these and other substitutions, modifications, changes, and omissions may be made in the design and arrangement of the elements and in their method of operation, as disclosed herein, without departing from the scope of the appended claims.

What is claimed is:

1. A method for installing a blind assembly on a wall, the blind assembly including a headrail and a blind, the headrail having a plurality of carrier trucks, the blind having a plurality of elongated louvers and a curtain integrally secured to the louvers, the method comprising:

hanging the headrail on the wall;

suspending the blind at a predetermined, spaced distance relative to the headrail from at least one installation hanger; and removing each louver from the at least one installation hanger and suspending each louver onto an associated one of the carrier trucks.

2. The method of claim 1, further comprising releasably securing the at least one installation hanger to the headrail.

3. The method of claim 2, wherein the releasably securing step comprises clamping the at least one installation hanger onto the headrail.

4. The method of claim 1, wherein the at least one installation hanger comprises two installation hangers, further comprising stacking the carrier trucks to one side of the headrail and positioning the installation hangers on opposite sides of the stack of trucks.

5. The method of claim 1, further comprising converting the blind from a shipping configuration to an installation configuration.

6. The method of claim 5, wherein the converting step comprises:

removing the blind from a shipping container, the louvers of the blind clamped at one end in a spaced relation to each other by a plurality of installation clips, a first threaded rod and at least one nut;

removing the at least one nut an d withdrawing the first threaded rod from the plurality of installation clips; and inserting a second threaded rod through the plurality of installation clips, replacing the at least one nut, and tightening the at least one nut to reclamp the louvers in spaced relation to each other.

7. The method of claim 6, further comprising lifting the blind up to the headrail and inserting the second threaded rod into at least one hole provided in the at least one installation hanger.

8. The method of claim 7, wherein the at least one installation hanger comprises two installation hangers spaced on opposite sides of a stack of carrier trucks, and the second threaded rod is inserted into at least one hole provided in each installation hanger, further comprising loosening the at least one nut and progressively transferring each louver from the associated installation clip to an associated carrier truck.

9. The method of claim 7, wherein each louver is secured at a predetermined, spaced distance from each adjacent louver by at least one packaging spacer, further comprising removing the at least one packaging spacer from the blind after the suspending step.

10. An apparatus for installing a blind on a mounted headrail, the headrail having a plurality of carrier trucks, the blind having a plurality of elongated louvers and a curtain integrally secured to the louvers, the apparatus comprising:

at least one installation hanger releasably attached to the mounted headrail; and a hanger assembly releasably coupled to the installation hanger wherein the blind is releasably secured to the hanger assembly so that an upper end of each louver is suspended in a spaced relation with the carrier trucks and each louver may be moved one at a time from the hanger assembly to an associated one of the carrier trucks.

11. The installation apparatus of claim 10, wherein the at least one installation hanger is configured to clamp onto the headrail.

12. The installation apparatus of claim 10, wherein the at least one installation hanger is stamped from steel.

13. The installation apparatus of claim 10, wherein the at least one installation hanger comprises a pair of installation hangers, each installation hanger including a frontwardly extending outrigger configured for coupling with the hanger assembly.

14. The installation apparatus of claim 13, wherein the outrigger of each installation hanger includes an aperture and the hanger assembly includes a plurality of installation clips and a rod, the rod having opposite ends extendable into the apertures with the plurality of louvers suspended from a portion of the rod intermediate the ends via the installation clips.

15. The installation apparatus of claim 10, wherein the hanger assembly comprises:

a plurality of installation clips, each clip having an aperture and nestable within an adjacent clip with the upper end of one louver secured therebetween, the apertures of the clips aligned when the clips are nested together; and a rod extendable through the aligned apertures of the nested clips.

16. The installation apparatus of claim 14, wherein the rod is a threaded rod, and the hanger assembly further includes at least one nut threadable onto the rod for applying a clamping pressure to the clips.

17. The installation apparatus of claim 14, wherein each clip has a J-shaped hook configured to clip into an aperture provided adjacent to the upper end of an associated louver.

18. The installation apparatus of claim 14, wherein the clips secure the upper ends of the louvers in a generally equally spaced relation to one another.

19. The installation apparatus of claim 10, further including at least one packaging spacer having a plurality of parallel slots, each slot configured for receiving one louver edgewise therein, the slots securing the louvers in generally equally spaced relation to one another.

20. A method for installing a blind assembly on a wall, the blind assembly including a headrail and a blind, the headrail having a plurality of carrier trucks, the blind having a plurality of elongated louvers and a curtain integrally secured to the louvers, the method comprising:

hanging the headrail on the wall;

removing the blind from a shipping container, the louvers of the blind clamped at one end in a spaced relation to each other by a plurality of installation clips;

inserting a rod through the plurality of installation clips;

suspending the blind at a predetermined, spaced distance relative to the headrail from at least one installation hanger; and moving each louver onto an associated one of the carrier trucks.

21. The method of claim 20, further comprising releasably securing the at least on installation hanger to the headrail.

22. The method of claim 21, wherein the releasably securing step comprises clamping the at least one installation hanger onto the headrail.

23. The method of claim 20, wherein the at least one installation hanger comprises two installation hangers, further comprising stacking the carrier trucks to one side of the headrail and positioning the installation hangers on opposite sides of the stack of trucks.

24. The method of claim 20, further comprising converting the blind from a shipping configuration to an installation configuration.

25. The method of claim 20, further comprising lifting the blind up to the headrail and inserting the rod onto at least one hole provided in the at least one installation.

26. The method of claim 21, wherein the at least one installation hanger comprises two installation hangers spaced on opposite sides of a stack of carrier trucks, and the rod is inserted into at least one hole provided in each installation hanger, further progressively transferring each louver from the associated installation clip to an associated carrier truck.

27. The method of claim 21, wherein each louver is secured at a predetermined, spaced distance from each adjacent louver by at least one packaging spacer, further comprising removing the at least one packaging spacer from the blind after the suspending step.

28. An apparatus for installing a blind on a mounted headrail, the headrail having a plurality of carrier trucks, the blind having a plurality of elongated louvers and a curtain integrally secured to the louvers, the apparatus comprising:

a pair of installation hangers releasably attached to the mounted headrail, each installation hanger including a forwardly extending outrigger having a plurality of apertures; and a hanger assembly releasably coupled with the forwardly extending outrigger and for releasably securing the blind adjacent the headrail so that an upper end of each louver is suspended in a spaced relation with the carrier trucks, the hanger assembly including a rod having opposite ends, the rod extending into the apertures with the plurality of louvers suspended from a portion of the rod intermediate the ends.

29. The installation apparatus of claim 28, wherein each installation hanger is configured to clamp onto the headrail.

30. The installation apparatus of claim 28, wherein each installation hanger is stamped from steel.

31. The installation apparatus of claim 28, wherein the hanger assembly including:

a plurality of installation clips, each clip having an aperture and nestable within an adjacent clip with the upper end of one louver secured therebetween, the apertures of the clips aligned when the clips are nested together; and a rod extending through the aligned apertures of the nested clips.

32. The installation apparatus of claim 28, wherein the rod is a threaded rod, and the hanger assembly further includes at least one nut threaded onto the rod for applying a clamping pressure to the clips.

33. The installation apparatus of claim 28, wherein each clip has a J-shaped hook configured to clip into an aperture provided adjacent to the upper end of an associated louver.

34. The installation apparatus of claim 28, wherein the clips secure the upper ends of the louvers in a generally equally spaced relation to one another.

35. The installation apparatus of claim 28, further including at least one packaging spacer having a plurality of parallel slots, each slot configured for receiving one louver edgewise therein, the slots securing the louvers in generally equally spaced relation to one another.

36. An apparatus for installing a blind on a mounted headrail, the headrail having a plurality of carrier trucks, the blind having a plurality of elongated louvers and a curtain integrally secured to the louvers, the apparatus comprising:

at least one installation hanger releasably attached to the mounted headrail; and a hanger assembly releasably attached coupling with the installation hanger and for releasably securing the blind adjacent the headrail so that an upper end of each louver is suspended in a spaced relation with the carrier trucks, the hanger assembly including:

a plurality of installation clips, each clip having an aperture and nestable within an adjacent clip with the upper end of one louver secured therebetween, the apertures of the clips aligned when the clips are nested together; and a rod extending through the aligned apertures of the nested clips.

37. The installation apparatus of claim 36, wherein each installation hanger is configured to clamp onto the headrail.

38. The installation apparatus of claim 36, wherein each installation hanger is stamped from steel.

39. The installation apparatus of claim 36, wherein the a least one installation hanger comprises a pair of installation hangers, each installation hanger including a frontwardly extending outrigger configured for coupling with the hanger assembly.

40. The installation apparatus of claim 39, wherein the outrigger of each installation hanger includes an aperture and the hanger assembly includes a rod, the rod having opposite ends extendable into the apertures with the plurality of louvers suspended from a portion of the rod intermediate the ends via the installation clips.

41. The installation apparatus of claim 36, wherein the rod is a threaded rod, and the hanger assembly further includes at least one nut threadable onto the rod for applying a clamping pressure to the clips.

42. The installation apparatus of claim 36, wherein each clip has a J-shaped hook configured to clip into an aperture provided adjacent to the upper end of an associated louver.

43. The installation apparatus of claim 36, wherein the clips secure the upper ends of the louvers in a generally equally spaced relation to one another.

44. The installation apparatus of claim 36, further including at least one packaging spacer having a plurality of parallel slots, each slot configured for receiving one louver edgewise therein, the slots securing the louvers in generally equally spaced relation to one another.

* * * * *

UNITED STATES PATENT AND TRADEMARK OFFICE

CERTIFICATE OF CORRECTION

PATENT NO. : 6,108,891
DATED : 08/29/00
INVENTOR(S) : Ruggles et al.

It is certified that error appears in the above-identified patent and that said Letters Patent is hereby corrected as shown below:

In Claim 6, column 10, line 58 of the issued patent the term "an d" should be --and--.

In Claim 21, column 12, line 17 of the issued patent the term "on" should be --one--.

In Claim 39, column 14, line 8 of the issued patent the term "a" should be --at--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*